United States Patent [19]

Thomas

[11] 4,126,916

[45] Nov. 28, 1978

[54] COUPON CLIP

[76] Inventor: Claude E. Thomas, 7066 Stone Brook, West Bloomfield, Mich. 48010

[21] Appl. No.: 798,072

[22] Filed: May 18, 1977

[51] Int. Cl.[2] ..... B42F 1/00

[52] U.S. Cl. ..... 24/67.9; 24/259 R

[58] Field of Search ..... 24/67 R, 67.1, 67.2, 24/67.3, 67.9, 67.11, 243, 259; 30/123, 124

[56] References Cited

U.S. PATENT DOCUMENTS

| | | | |
|---|---|---|---|
| 576,771 | 2/1897 | Adams | 30/123 |
| 3,283,421 | 11/1966 | Schott | 24/67.9 |

*Primary Examiner*—Henry S. Jaudon

*Attorney, Agent, or Firm*—Cullen, Sloman, Cantor, Grauer, Scott & Rutherford

[57] ABSTRACT

A clip for holding coupons, bills or the like and which has a pair of cooperating legs at least one of which has an edge adapted to tear or cut a coupon along a selected line.

3 Claims, 2 Drawing Figures

COUPON CLIP

SUMMARY — BACKGROUND OF THE INVENTION

The present invention relates to clips for holding coupons or the like and more specifically to a clip having at least one edge adapted to tear or cut a coupon along a selected line.

It has become a common occurrence to provide sales discounts on various goods by means of coupons located in papers such as circulars, newspapers, etc. The recipient of such papers is required to clip out the coupon from the remainder of the paper and uses a pair of scissors or tears the coupon out by hand leaving irregular sides. Frequently the recipient accumulates a plurality of coupons from one or more papers. Two problems present themselves — the first is a convenient means of carrying the coupons and the second is a convenient means of clipping the coupon from the paper in which it is located.

The present invention has features directed to both problems. Therefore, it is an object of the present invention to provide a novel clip which provides a means for retaining together a plurality of coupons and means for clipping such coupons from the papers in which they are located.

It is another general object to provide an improved clip for holding coupons or the like.

Figure 1:
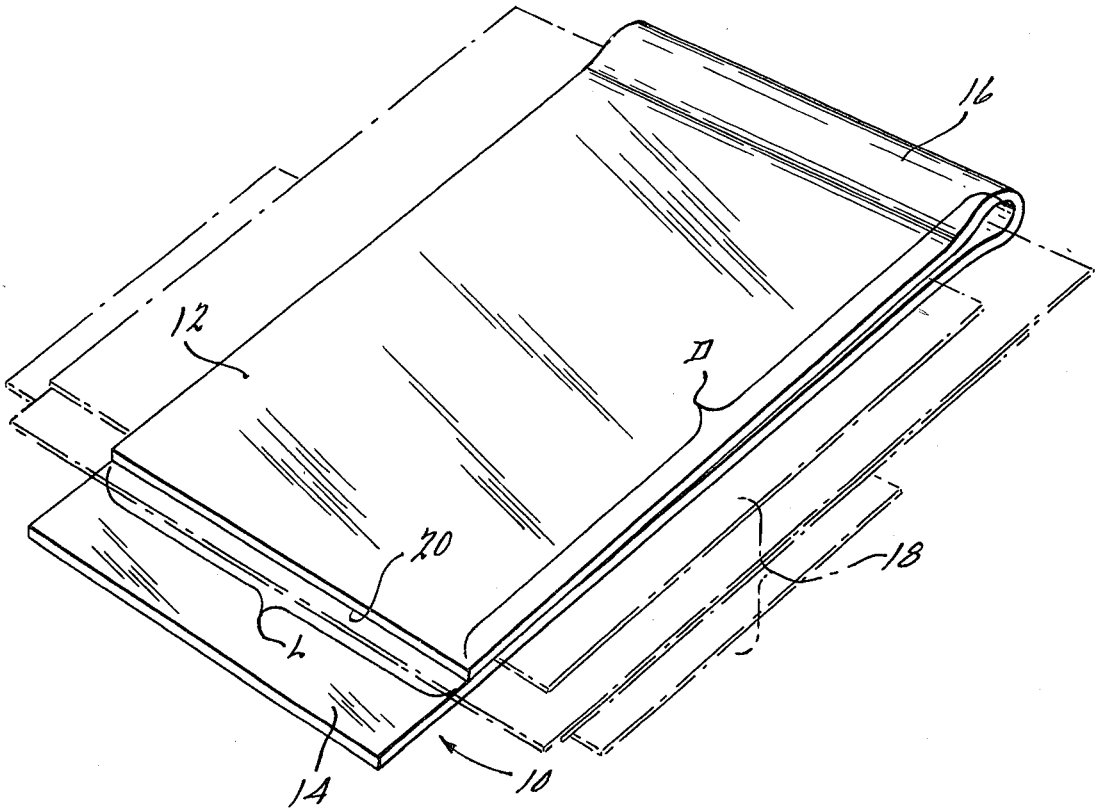
Figure 2:
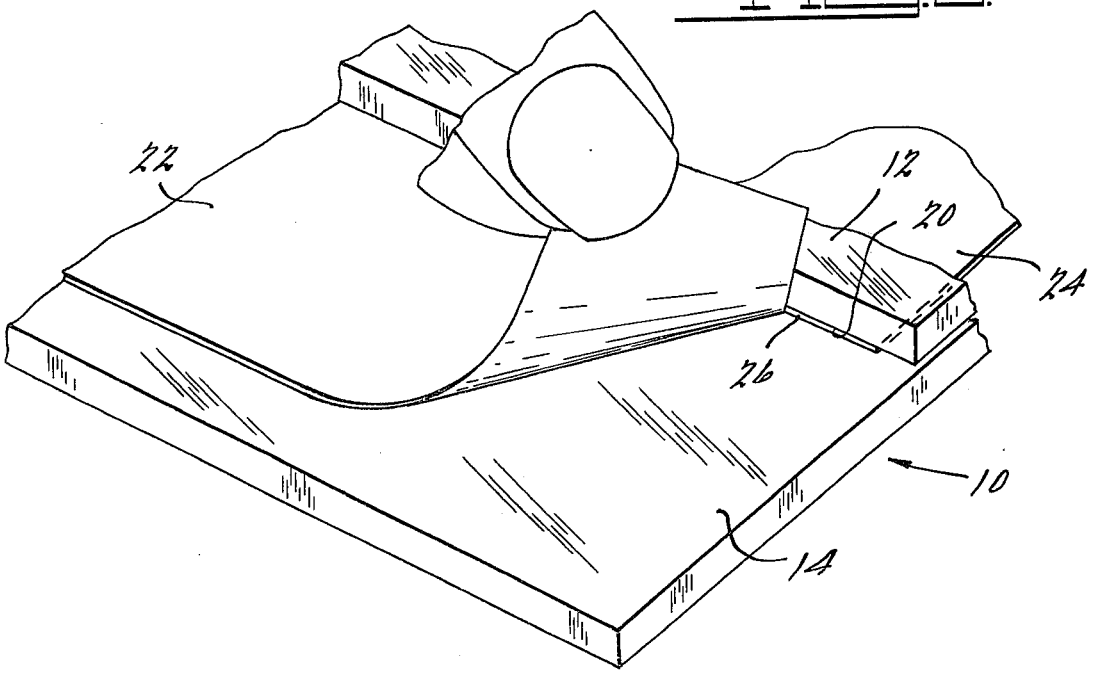

Other objects, features and advantages of the present invention will become apparent from the subsequent description and the appended claims, taken in conjunction with the accompanying drawing, in which:

FIG. 1 is an isometric view of a clip embodying features of the present invention and depicting it retaining a plurality of coupons drawn in phantom; and FIG. 2 is a fragmentary isometric view of a portion of the clip of FIG. 1 to increased scale and depicting its use in removing a coupon from its paper of orgin by tearing away the surrounding portions of the paper.

Looking now to the drawing, a one piece clip 10 is shown and comprises a pair of parallely extending legs 12 and 14 connected together by a resilient hinge 16.

Preferably, the clip 10 is of a uniform width such that legs 12 and 14 generally overlay each other. One leg 12 is shorter than the other leg 14 to facilitate tearing of the paper surrounding the coupons in a manner to be seen. The flexible hinge 16 is provided to resiliently urge the legs 12 and 14 into a closed position whereby they will engage each other such that coupons or other papers 18 (shown in phantom) can be securely held.

The leg 12 is provided with a relatively sharp edge 20 which is normally urged into engagement with the other leg 14 by the resilient hinge 16. Note that the legs 12 and 14 are angulated towards each other such that there is a tendency to have good contact of the edge 20 with the cooperating surface of the other leg 14.

When it is desired to clip a coupon, from a newspaper for example, the clip 10 can be used in the manner shown in FIG. 2. Thus a paper 22 containing a coupon 24 can be placed in the clip 10 with the edge 20 located along the line 26 of the coupon to be clipped. While holding the legs 12 and 14 together with one hand the edge 20 engages the paper 22 and with the fingers of the other hand the page 22 can be torn cleanly along the line 26 whereby the coupon 24 can be removed from the page 22. This task being done, the coupon 24 can now be securely retained within the clip 10.

While the clip 10 can be made of a metal such as stainless steel, in a preferred form, the clip 10 is made of a clear thermoplastic material. The clear plastic is preferred since it permits the bearer to identify the coupons held therein. The thickness of the material is preferably between 1/16 and ⅛ inch. In order to facilitate tearing it is preferred that the tearing edge 20 have a length "L" of at least around 1½ inches long, i.e. the width of the leg 12. A length of 2 inches is preferred since that would more readily accommodate the width of a larger number of coupons. A preferred range of edge length is 1½ to 3 inches.

In order to facilitate tearing of a coupon along its width, it is desirable that the depth "D" of the groove defined between legs 12 and 14 be preferably at least around 3½ inches.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

What is claimed is:

1. A clip made of a clear thermoplastic material having a thickness in the range of from about 1/16 to about ⅛ inch for holding coupons or the like and for tearing coupons or the like from a paper comprising: a first leg, a second leg overlaying said first leg, said first leg being shorter than said second leg, a resilient hinge connecting said first and second legs at one end and resiliently urging the opposite ends of said legs into engagement, said legs generally converging toward each other from said hinge toward the distal end of each leg for removably storing coupons therebetween, one of said legs having an edge generally extending across its width at its distal end, said edge facing the other of said legs and being relatively sharp and having a length in the range of at least 1½ to 3 inches whereby coupons or the like can be torn from a paper along said sharp edge and retained in said clip for storage, and wherein said one leg defines with said other leg a groove at least around 3½ long.

2. The invention as defined in claim 1 wherein said first and second legs and said hinge are integrally formed as a unitary construction.

3. The invention as defined in claim 1 wherein said first and second legs and said hinge are integrally formed of a unitary, resilient, clear thermoplastic material.

* * * * *